US009211699B2

(12) United States Patent
Rossell et al.

(10) Patent No.: US 9,211,699 B2
(45) Date of Patent: Dec. 15, 2015

(54) METHOD OF CONTROLLING A PRINTER AND PRINTER HAVING AT LEAST ONE PRINT BAR

(75) Inventors: Marti Rius Rossell, Sant Cugat del Valles (ES); Sergio Puigardeu Aramendia, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/411,823

(22) PCT Filed: Jul. 10, 2012

(86) PCT No.: PCT/EP2012/003036

§ 371 (c)(1), (2), (4) Date: Dec. 29, 2014

(87) PCT Pub. No.: WO2014/008910

PCT Pub. Date: Jan. 16, 2014

(65) Prior Publication Data

US 2015/0197082 A1 Jul. 16, 2015

(51) Int. Cl.

| | |
|---|---|
| ***B41J 29/38*** | (2006.01) |
| ***B41J 2/045*** | (2006.01) |
| ***B41J 29/393*** | (2006.01) |
| ***B41J 2/21*** | (2006.01) |
| ***B41J 25/00*** | (2006.01) |
| *B41J 2/165* | (2006.01) |

(52) U.S. Cl.

CPC ..... *B41J 2/04508* (2013.01); *B41J 2/04586* (2013.01); *B41J 2/2139* (2013.01); *B41J 2/2142* (2013.01); *B41J 2/2146* (2013.01); *B41J 25/001* (2013.01); *B41J 29/393* (2013.01); *B41J 2/0451* (2013.01); *B41J 2/04543* (2013.01); *B41J 2002/16502* (2013.01)

(58) Field of Classification Search

None

See application file for complete search history.

(56) References Cited

U.S. PATENT DOCUMENTS

| | | | | |
|---|---|---|---|---|
| 6,089,693 | A | 7/2000 | Drake et al. | |
| 7,850,271 | B2 | 12/2010 | Gothait et al. | |
| 2007/0176953 | A1 | 8/2007 | Han | |
| 2008/0136853 | A1 * | 6/2008 | Kinoshita | 347/12 |
| 2012/0105529 | A1 | 5/2012 | Powers et al. | |
| 2012/0114188 | A1 * | 5/2012 | Murase et al. | 382/112 |

FOREIGN PATENT DOCUMENTS

WO WO-2008065657 A2 6/2008

* cited by examiner

*Primary Examiner* — Lisa M Solomon

(74) *Attorney, Agent, or Firm* — HP Inc. Patent Department

(57) ABSTRACT

The invention relates to a method of controlling a printer, the printer having an array of nozzles which extends across a print zone of the printer, the method comprising the steps of: evaluating a nozzle status of the array of nozzles; printing a first swath across the print media in the print zone, wherein the array of nozzles is located in a first position during printing of the first swath; determining a second position of the array of nozzles for printing a second swath so that, under consideration of the determined nozzle status, the combined output of the first and second swaths meets a predetermined criterion; moving the array of nozzles to the determined second position and printing the second swath across the print media in the print zone.

13 Claims, 5 Drawing Sheets

METHOD OF CONTROLLING A PRINTER AND PRINTER HAVING AT LEAST ONE PRINT BAR

BACKGROUND OF THE INVENTION

Printers are known which use arrays of nozzles which extend across all of a print zone. Such arrays of nozzles often are arranged in print bars, the print bars carrying one or more parallel columns of nozzles. One example of this type of printers is a page-wide array (PWA) printer. In general, a page-wide array printer has a print media transport path and a print head or a group of print heads extending across a width of the print media transport path. Due to the relative length of the print heads, when compared to their width, they are also called print bars. Such an arrangement allows the entire width of a print media to be printed simultaneously. Print media may be any sort of sheet-like medium, including paper, cardboard, plastic, and textile.

The print bar is usually mounted to the printer, and the print media on which an image is to be printed is moved past the print bar along the print media transport path. A complete image can be printed in a single printing pass or in multiple passes.

Page-wide array printers may be sensitive to local problems or discontinuities in their nozzle arrays arranged in said print bars. As an example of such sensitivity, if a nozzle is not ejecting ink, this results in a lighter line or missing printed information. In another case, a region of the print bar may be ejecting ink in a way that a portion of an image has a different color density than its neighbor, thus creating a printing quality artifact.

A typical way to overcome those issues is by having nozzle redundancy in the form of multiple print bars, multiple columns of nozzles on one print bar and/or printing in multiple passes.

Nozzle redundancy is commonly used to substitute a failing nozzle by another one that ejects ink in the same or a close print media spot. Redundancy may be implemented in the same physical print bar in the form of closely placed nozzles, e.g. in parallel columns, or in another print bar located at a given distance that provides extra nozzles, or by moving the print medium multiple times under the same print bar. However, redundancy is typically limited because of print bar costs or throughput constraints. If nozzle substitution cannot be performed, on the other hand, the printing artifacts are usually so severe that the affected print head needs to be replaced.

BRIEF DESCRIPTION OF DRAWINGS

Examples of the invention will now be described, by way of example only, with reference to the accompanying drawings:

FIG. 1 schematically shows a page-wide array printer 1 as one example of an environment in which examples of the invention can be practised. The printer 1 comprises a print head array 3 on which one or more print bars 5 are mounted. The print head array comprises at least one print bar or a plurality of print bars, such as for different colors, for example. At least one print bar extends across the width of a print zone and hence has substantially the same length as the complete print head array; see FIG. 2.

Figure 1:
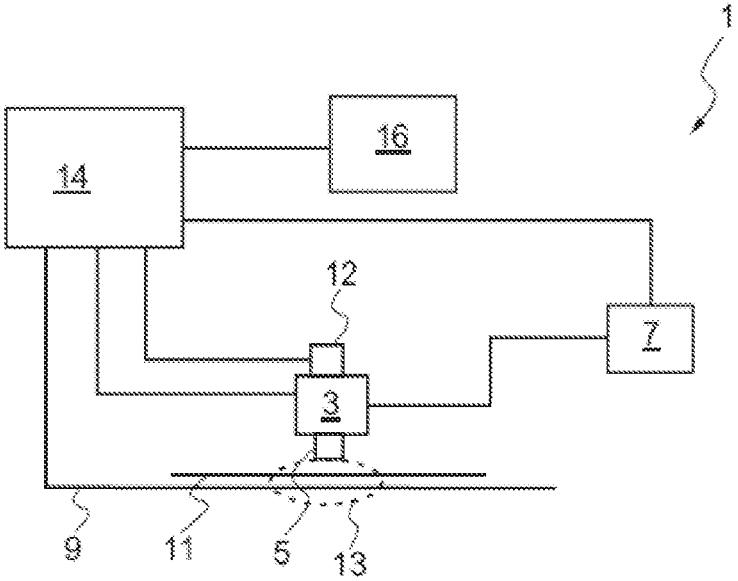
FIG. 1 is a schematic view of a page-wide array printer according to one example.

Ink is supplied to the print bar 5 from an ink tank 7. The printer 1 may comprise a print head array for each color or type of ink to be printed, each ink having its own tank. However, for clarity, only one print head array is shown, including only one print bar 5.

The print bar comprises a number of nozzles (not shown in FIG. 1) which can be in the region of several hundred, one thousand, or more. The structure of the nozzles as such is conventional, and will not be described in detail.

The printer 1 further comprises a print media transport mechanism 9 which, in use, is operative to transport a print media 11 to be printed upon through a print zone 13 below the print head array 3. The print media transport mechanism 9 is operable to transport the print media through the print zone 13 in at least one direction.

The printer further comprises a print head positioning mechanism 12 operative to move the print bar 5 in a direction substantially parallel to the longitudinal extent of the array and perpendicular to the print media transport direction, as described in further detail below.

A printer controller 14, such as a microprocessor, for example, is operative to control firing of the nozzles and the movement of the print media through the print zone 13. The printer controller also controls the supply of ink to the print bar 5 from the ink tank 7 and the movement of the print bar by the positioning mechanism 12. Instead of one controller, separate controllers could be installed for the print media transport mechanism 9, the print bar 5, and the ink supply from the tank 7. The controller has access to a memory 16. Images or jobs for the printer to print can be stored in the memory 16 until they are printed onto the print media by the printer.

Figure 2:
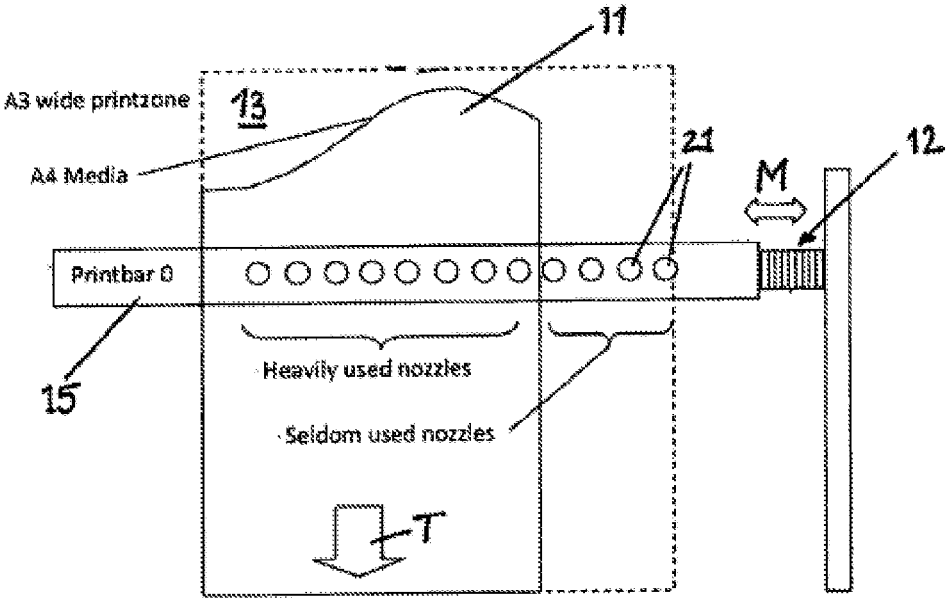
FIG. 2 is a schematic top view of a print bar including a nozzle array which extends across a print zone.

FIG. 2 shows the print bar positioning mechanism 12 and the print bar 5 relative to the print zone 13 in further detail. As shown in FIG. 2 the print bar 5 comprises an array of nozzles 21 which extends across the width of the print zone 13, the print media 11 being shown by way of example as a A4 size media 11 on a A3 wide print zone 13. These dimensions are given by way of example only.

As indicated by the double-headed arrow M in FIG. 2, the print bar 15 can be moved perpendicular to the print media transport direction T using the positioning mechanism 12.

The print zone 13 often is wider than the print media 11 commonly used. Hence there often will be heavily used nozzles as well as seldom used nozzles, as indicated in FIG. 2. It can be expected that the heavily used nozzles are more susceptible to failure than the seldom used nozzles.

If a nozzle fails, or if nozzles generate print outputs at unequal color densities, such failure or malfunctioning can be corrected by a lateral movement of the print bar 15 during a multi-pass printing mode so as to maximize redundancy properties. The robustness of the printer hence is increased.

The operation of the system of FIGS. 1 and 2 is described, by way of example, with reference to FIGS. 3 to 6. In the description of the examples, the following should be taken into account: For providing redundancy, the controller 14 can evaluate the nozzle status of the array of nozzles in the print bar 15 and control the printer to print a first swath across print media 11 with the print bar 15 located in a first position and a second swath across print media 11 with the print bar located in a second position. The combination of the first and second positions is determined, under consideration of the nozzle status, so that the combined output of the first and second swaths meets a predetermined criterion. One example of such a criterion is that a maximum number of failing nozzles in the first position can be replaced by properly firing the nozzles in the second position, wherein for determining this criterion, the image to be printed can be taken into account. Another example of a criterion can be the color density of the combined first and second swaths, e.g. to achieve a uniform color density of the print area. Accordingly, when evaluating a nozzle status, it can be determined whether the nozzles of the print bar are firing properly or failing and/or the color density of the nozzles can be determined.

The print bar 15 can be moved continuously or stepwise between the first and second positions. The print bar also can be moved to third and further positions for printing additional swaths and further maximizing nozzle redundancy.

The probability of having a failing nozzle or nozzles outputting ink at unequal color densities increases with the width of the printer and, therefore, large format printers are more likely to have problems. Accordingly, in large format printers and page-wide array printers, for example, additional print bars and/or print bars having multiple parallel columns of nozzles for providing redundancies have been used. Extra print bars also have been employed to average uneven nozzle properties, such as drop weight or drop shape, along a print bar which results in color density differences along the plot. However, even with the use of extra print bars, there is no guarantee that unevenness along the print bar cancels out and, in fact, in some cases unevenness may even add up along bars and make the defect worse. Uneven nozzle properties may come from the manufacturing process or they may be due to uneven nozzle usage, for example when an A3 printer prints a large number of A4 sheets, as in the example of FIG. 2. In this case, nozzles with more usage tend to degrade faster than their neighbors, and this usually results in a lower drop weight. When, in such a case, A3 sheets are printed again, the resulting color difference is clearly seen as banding. As explained above, prior solutions to failing nozzles basically consists in adding redundancies so that nozzle replacement can be done. One solution is to add more nozzles in the same silicone die, usually in a position so close to another nozzle that nozzle substitution can be done directly. One of the problems associated with this approach is that the effects of dust particles, or damages caused by media jam, are likely to affect a number of neighboring nozzles, because of their proximity so that the redundancy concept fails. A second solution in the art is to add more nozzles in the form of extra print bars or even adding a larger number of redundant print bars which goes at the expense of extra costs and complexity.

The current examples overcome the problem of failing or malfunctioning nozzles and provides redundancy in printing using a single print bar which is moved between different positions for printing multiple swaths in a multi-pass mode. The lateral movement of the print bar is not set to the same predefined positions and also need not be set in fixed predefined steps but the first and second positions, and possibly further positions, are calculated based on the nozzle status previously evaluated to maximize nozzle replacement, reduction of banding and the like. In addition to evaluating the nozzle status, also the image to be printed can be taken into account when determining the first and second and possibly further positions of the print bar.

Figure 3:
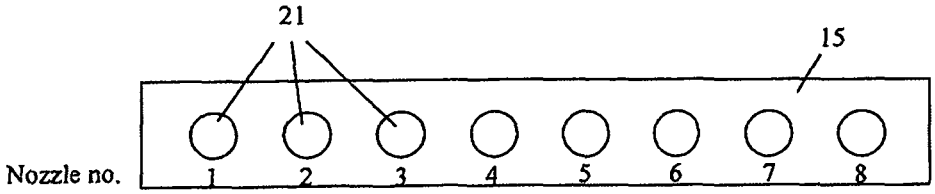
FIG. 3 is a schematic view of a page-wide array print bar relative to an image to be printed.
Figure 3:
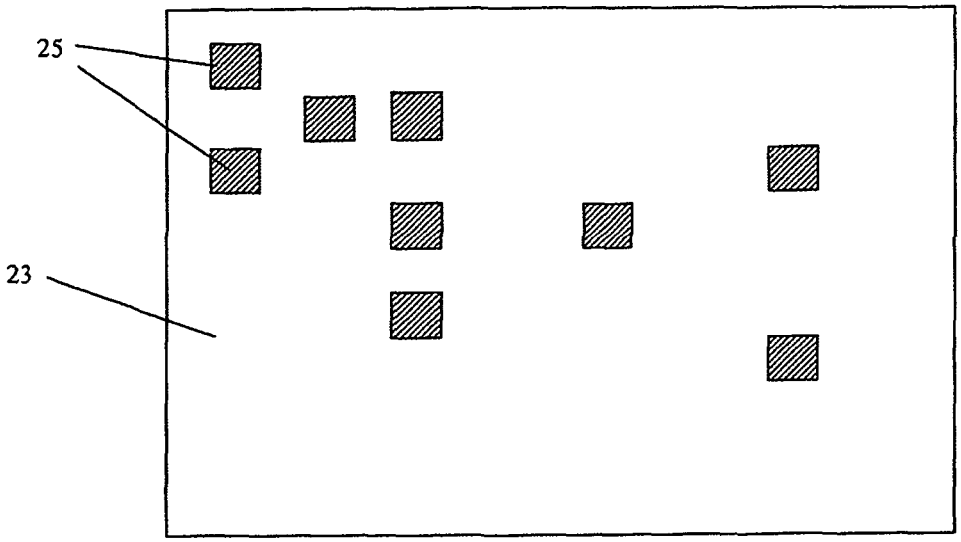

FIG. 3 schematically shows a print bar in which nozzles 21 are numbered from 1 to 8 and an image 23 to be printed by said print bar 15. One skilled in the art will understand that, in a practical embodiment, the print bar 15 will have a much larger number of nozzles 21 but the nozzle array shown in FIG. 3 should be sufficient for illustrating the example. The image 23 to be printed includes, in the section shown in FIG. 3, a number of picture elements or pixels 25 where a drop of ink is to be placed. Each pixel 25 is illustrated by a hatched rectangle. In the example of FIG. 3, nozzles no. 1, 2, 3, 5 and 7 are needed for printing image 23 using print bar 15.

If one or more of the nozzles 21 fail, one example of the described method will print the image 23 in a multi-pass print mode, such as in two passes, for replacing failing nozzles of the print bar 15 by healthy nozzles wherein the print bar is moved laterally, in the direction of its length, between two passes. In one example, the first position may be fixed and the offset between the first and second positions of the print bar 15 for printing the two passes is calculated based on the nozzle status and, optionally, the image to be printed. In another example, the first and second positions can be selected more freely, and the combination of first and second positions is calculated based on the nozzle status and, optionally, the image to be printed.

Figure 4:
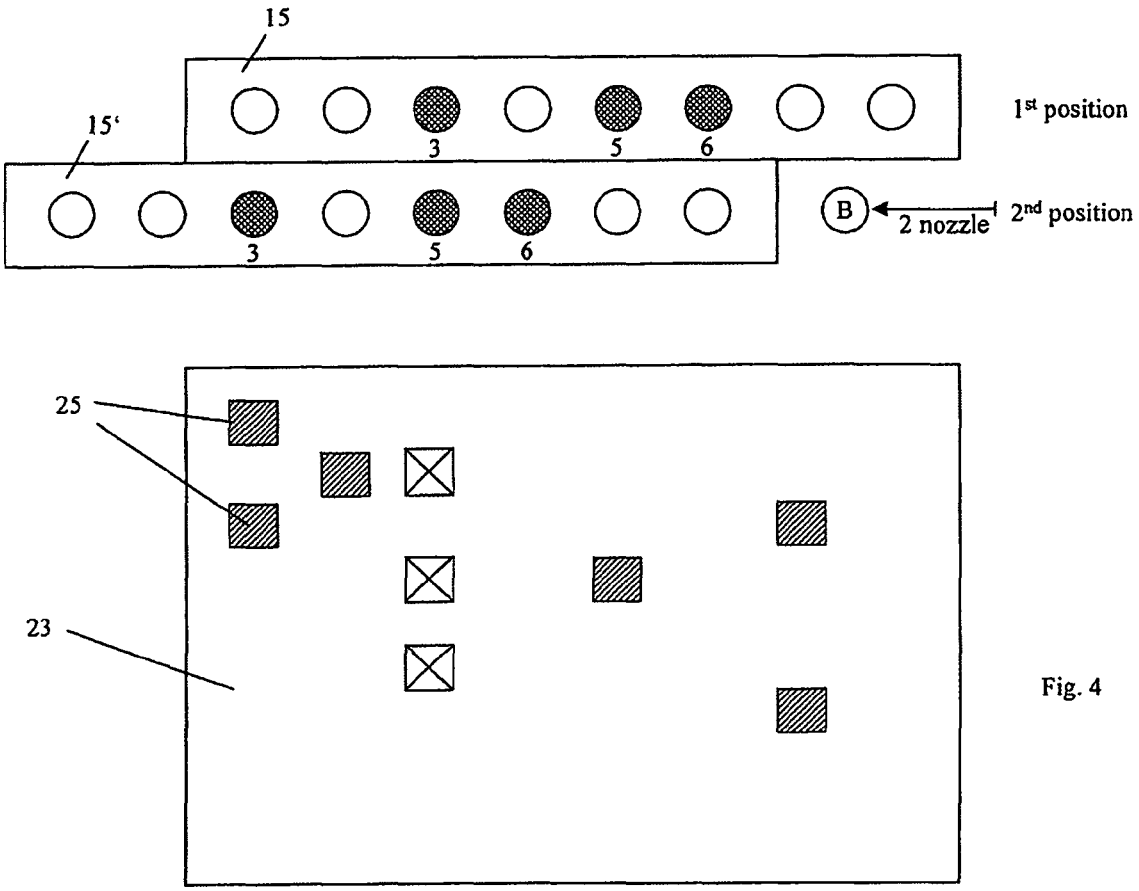
FIGS. 4 and 5 are two schematic views for illustrating the relative movement of the print bar of FIG. 3 for printing the image of FIG. 3.

In the example shown in FIG. 4, it is assumed that nozzles no. 3, 5 and 6 are failing (cross-hatched nozzles) and that the same image 23 as the one shown in FIG. 3 shall be printed. In the example of FIG. 4, the print bar 15 is moved from a first position by two nozzle pitches to the left. Print bar 15 is designated as 15' in the second position. With this offset, failing nozzle no. 3 is aligned with failing nozzle no. 5 so that three of the pixels, aligned with these failing nozzles, cannot be printed—these pixels are illustrated by crossed-out rectangles. Pixels 25 that can be printed are illustrated by hatched rectangles 25. Accordingly, FIG. 4 shows an unsuitable combination of first and second positions of the print bar 15 for printing image 23. This example illustrates that an arbitrary or predefined offset between the first and second positions of the print bar 15 for printing multiple swaths in multiple passes might not be a suitable approach for providing redundancy and compensating for failing or malfunctioning nozzles.

Figure 5:
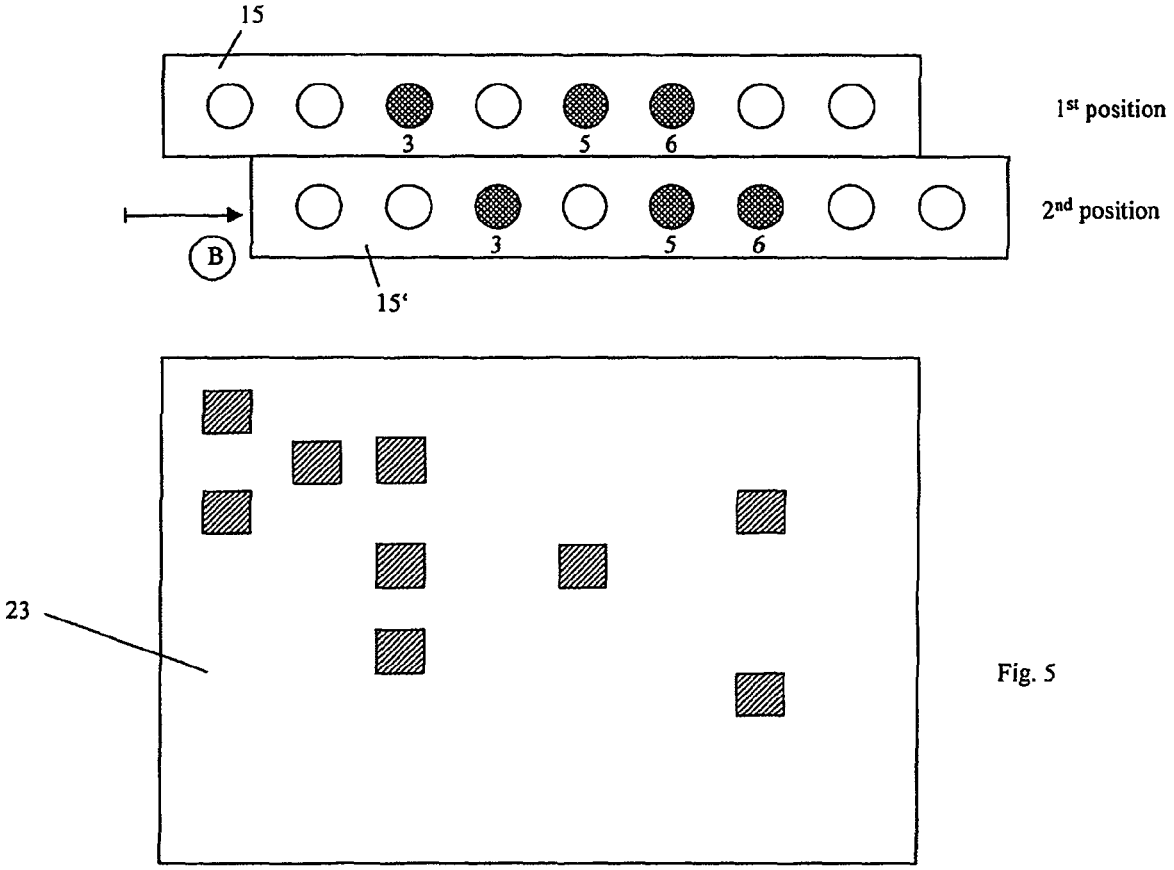

In the example of FIG. 5, the first position is the same as in the example of FIG. 4 and the second position is calculated after the nozzle status or nozzle health has been determined, taking into account the image to be printed. Again, it is assumed that nozzles no. 3, 5 and 6 are failing and that the same image 23 as in FIG. 3 shall be printed. In the example of FIG. 5, a combination of first and second positions of the print bar 15 is calculated so that each nozzle necessary for printing the image 23 which is failing or malfunctioning can be replaced by a functioning nozzle, and the print bar 15 is moved to the first and second positions for printing successive swaths in successive passes.

The nozzle status of the print bar can be evaluated e.g. by looking at its firing/failing status using a drop detector or using optical inspection means, for example. Both the nozzles as such as well as the printout of the print bar at any position can be used for making this evaluation. Additionally, or alternatively, it is also possible to look at the relative color density output along a print bar, e.g. using a densitometer or an optical inspection means, for example.

Under consideration of the image to be printed, the system determines the best combination of first and second positions so that substitution of failing nozzles by healthy ones is guaranteed or at least maximized and/or unevenness between the outputs of the nozzles of the single print bar is cancelled or equalized.

In one example, determination of the best printing positions of the print bar can start by obtaining a list of failing nozzles of the print bar. When the print bar can be moved in predefined discrete steps, it is possible to evaluate the full subset of first and second positions and, for each subset, to list all failing nozzles that cannot be substituted. The subsets of first and second positions are ranked according to the number of failing nozzles which cannot be replaced by properly firing nozzles in the first and second positions and that subset is chosen which has none or the fewest number of non-substitutable nozzles. The image is then printed in (at least) two passes with the print bar at the first and second positions. If the print bar 15 can be moved continuously, a subset of possible first and second positions is selected for evaluation. The evaluation of combinations of first and second positions can be performed under consideration of the image to be printed or irrespective of this image. In the latter case, it can be assumed that the print bar needs to be able to provide full coverage of a page to be printed.

In another example, the criterion for determining the first and second positions can be based on the relative color density along the print bar. A resulting color density can be estimated for each subset of first and second positions, for example by adding the color density functions. In one example, the subset of first and second positions and associated offset can be selected which has the least variability of added color density functions. Another criterion could be to minimize the local rate of color variation.

In one example, the print bar can be moved in a direction perpendicular to the print media transport direction by at least 4, 5, 7, 8, 9, or 10 nozzle pitches.

Figure 6:
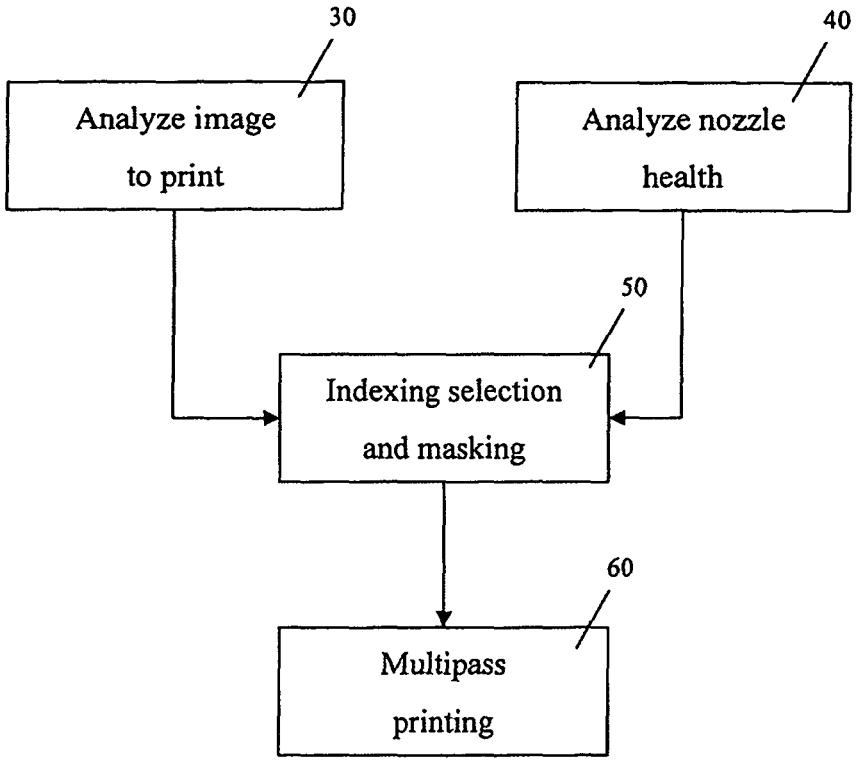
FIG. 6 is a schematic flow diagram according to one example.

FIG. 6 shows a flow diagram of one example of a method of controlling a printer. In first and second steps, the image to be printed is analyzed (30) and the nozzle health is determined (40). These steps can be performed sequentially or simultaneously. In the step 40 of determining nozzle health it is possible to provide a nozzle health statistic in the form of a table, indicating whether a nozzle is firing or failing, the color density generated by the nozzle or the like. The information obtained in steps 30 and 40 is passed to a step 50 of indexing selection and masking in which first and second (and possibly more) positions of the print bar are determined, and masks for selecting nozzles for firing in each of the positions are calculated. The print bar positions and masks calculated in step 50 are used in a subsequent multi-pass printing step 60.

It is possible to move the print media between printing passes. For example, it is possible to move the print bar 15 to the first determined position, print one swath of the image while moving the print media by one inch, retract the media by half an inch and move the print bar 15 to the second position, print another swath of one inch of the image and again retract the media by half an inch. This way, each area of the print media will be printed onto twice but successive swaths will always only overlap by half a swath width. A person of skill in the art will understand that swath widths and overlaps can be adjusted as needed.

The examples of this invention increase the robustness of the printing method against even a larger number of nozzle failures using only a single print bar. Without an increase in hardware, the printer can achieve a higher perception and reliability.

The invention claimed is:

1. A method of controlling a printer, the printer having an array of nozzles which extends across a print zone of the printer, the method comprising:

evaluating a nozzle status of the array of nozzles;

printing a first swath across a print medium in the print zone, wherein the array of nozzles is located in a first position during printing of the first swath;

determining a second position of the array of nozzles for printing a second swath so that, under consideration of the determined nozzle status, a combined output of the first and second swaths meets a predetermined criterion;

moving the array of nozzles to the determined second position and printing the second swath across the print media in the print zone;

wherein during evaluating a nozzle status, it is determined whether the nozzles of the nozzle array are firing properly or failing; and wherein, when the array of nozzles is moved in discrete steps, during evaluating a nozzle status, a list of failing nozzles is determined; and during determining the second position, all possible combinations of the first and the second positions of the array of nozzles are evaluated, the combinations are ranked according to the number of failing nozzles at the first position of the array of nozzles which are not replaced by properly firing nozzles at the second position of the array of nozzles, and a combination resulting in a lowest number of failing nozzles which are not replaced by properly firing nozzles is used for determining the first and second positions.

2. The method of claim 1, wherein, during determining the second position, a combination of the first and the second positions is determined so that a maximum number of failing nozzles at the first position of the array of nozzles are replaced by properly firing nozzles at the second position of the array of nozzles.

3. The method of claim 1, wherein during evaluating a nozzle status, a list of failing nozzles is determined; and during determining the second position, (i) a combination of the first and the second positions of the array of nozzles is evaluated according to the number of failing nozzles of the array of nozzles at the first position which are not replaced by properly firing nozzles of the array of nozzles at the second position, and (ii) when the combination results in less than a predetermined number of failing nozzles which are not replaced by properly firing nozzles, this combination is used for determining the second position, (iii) when the combination results in more than a predetermined number of failing nozzles which are not replaced by properly firing nozzles, a next combination is selected and (ii) and, when necessary, (iii) are repeated for the next combination;

(iv) when after a predetermined number of combination evaluations, none of the combinations evaluated in [steps (i) to (iii) results in not less than said predetermined number of failing nozzles which are not replaced by properly firing nozzles, a combination resulting in a lowest number of failing nozzles which are not replaced by properly firing nozzles is selected for determining the second position.

4. The method of claim 3 wherein the predetermined number is one.

5. The method of claim 4 wherein the array of nozzles is moved in a continuous movement or stepwise.

6. A method of controlling a printer, the printer having an array of nozzles which extends across a print zone of the printer, the method comprising:

evaluating a nozzle status of the array of nozzles;

printing a first swath across a print medium in the print zone, wherein the array of nozzles is located in a first position during printing of the first swath;

determining a second position of the array of nozzles for printing a second swath so that, under consideration of the determined nozzle status, a combined out of the first and second swaths meets a predetermined criterion;

moving the array of nozzles to the determined second position and printing the second swath across the print medium in the print zone;

wherein during evaluating a nozzle status, a color density of the nozzles of the array of nozzles is determined.

7. The method of claim 6, wherein during determining the second position, a combination of the first and the second positions is determined so that a color density of the combined swaths printed at the first and second positions is equalized.

8. The method of claim 6, wherein during determining a combination of the first and the second positions, the combined color densities of pairs of nozzles are determined wherein each pair of nozzles comprises those nozzles of the array of nozzles which are aligned when the array of nozzles is moved between the first and second positions, and wherein that combination is selected for determining the first and second positions in which the combined color densities of said pairs of nozzles meet said predetermined criterion.

9. The method of claim 8, wherein during determining the second position, that combination is selected in which the combined color densities of said pairs of nozzles have the least variability among each other or have a minimum local rate of color variation.

10. The method of claim 1 further comprising:

providing one print bar comprising said array of nozzles, wherein said array of nozzles extends along said print bar in at least one column across the whole width of the printer's print zone, said at least one column being oriented perpendicular to a feed direction of the print medium.

11. The method of claim 10, wherein the print bar is moved in a direction perpendicular to said feed direction of the print medium, by a distance which corresponds to at least two nozzle pitches of said array of nozzles.

12. The method of claim 6, further comprising: providing one print bar comprising said array of nozzles, wherein said array of nozzles extends along said print bar in at least one column across the whole width of the printer's print zone, said at least one column being oriented perpendicular to a feed direction of the print medium.

13. The method of claim 12, wherein the print bar is moved in a direction perpendicular to said feed direction of the print medium, by a distance which corresponds to at least two nozzle pitches of said array of nozzles.

* * * * *

UNITED STATES PATENT AND TRADEMARK OFFICE

CERTIFICATE OF CORRECTION

PATENT NO. : 9,211,699 B2
APPLICATION NO. : 14/411823
DATED : December 15, 2015
INVENTOR(S) : Rossell et al.

It is certified that error appears in the above-identified patent and that said Letters Patent is hereby corrected as shown below:

In the claims

Column 6, line 23, Claim 2, delete "wherein," and insert -- wherein --, therefor.

Column 6, line 57, Claim 5, delete "claim 4" and insert -- claim 3 --, therefor.

Column 7, line 1, Claim 6, delete "out" and insert -- output --, therefor.

Signed and Sealed this
Twenty-eighth Day of June, 2016

Michelle K. Lee

Michelle K. Lee
*Director of the United States Patent and Trademark Office*